US010287937B2

(12) United States Patent
Solferino et al.

(10) Patent No.: US 10,287,937 B2
(45) Date of Patent: May 14, 2019

(54) EXHAUST SYSTEM FOR AN ENGINE

(71) Applicant: Ford Global Technologies, LLC, Dearborn, MI (US)

(72) Inventors: Vincent Paul Solferino, Dearborn, MI (US); Brian Schabel, Northville, MI (US); Joseph Van Gilder, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 283 days.

(21) Appl. No.: 15/185,415

(22) Filed: Jun. 17, 2016

(65) Prior Publication Data

US 2017/0362976 A1 Dec. 21, 2017

(51) Int. Cl.

| | |
|---|---|
| ***F01N 1/02*** | (2006.01) |
| ***F01N 1/16*** | (2006.01) |
| ***F01N 13/02*** | (2010.01) |
| ***F01N 13/04*** | (2010.01) |
| ***F01N 13/10*** | (2010.01) |

(52) U.S. Cl.

CPC ..... *F01N 1/02* (2013.01); *F01N 1/163* (2013.01); *F01N 1/168* (2013.01); *F01N 13/02* (2013.01); *F01N 13/04* (2013.01); *F01N 13/107* (2013.01); *F01N 2240/36* (2013.01); *F01N 2340/02* (2013.01); *F01N 2470/20* (2013.01)

(58) Field of Classification Search

CPC . F01N 1/02; F01N 1/163; F01N 1/168; F01N 13/02; F01N 13/04; F01N 13/107; F01N 2240/36; F01N 2340/02; F01N 2470/20

See application file for complete search history.

(56) References Cited

U.S. PATENT DOCUMENTS

| | | | | |
|---|---|---|---|---|
| 3,943,710 A * | 3/1976 | Lange | F01N 3/2006 | 422/177 |
| 5,449,866 A | 9/1995 | Moss | | |
| 7,090,048 B2 * | 8/2006 | Albertson | F01N 1/02 | 181/237 |
| 8,418,445 B2 * | 4/2013 | Laube | F01N 1/00 | 181/238 |

(Continued)

FOREIGN PATENT DOCUMENTS

| | | |
|---|---|---|
| JP | 2004293456 A | 10/2004 |
| WO | 2011036700 A1 | 3/2011 |

*Primary Examiner* — Jason D Shanske
*Assistant Examiner* — Matthew T Largi
(74) *Attorney, Agent, or Firm* — Brooks Kushmam P.C.; Julia Voutyras

(57) ABSTRACT

An exhaust system for an engine has a volume element such as a muffler or a silencer. First and second exhaust pipes are connected as dual exhaust pipes upstream of or downstream of the volume element. The first exhaust pipe has a first length (L1). A valve is positioned in the second exhaust pipe at a distance (D) from the volume element. The distance D is a fraction of L1 such that the second pipe is a resonator for the first pipe with the valve in a closed position. A method of controlling exhaust noise includes positioning a valve in the first exhaust pipe at a distance (D) from a volume element with D being a specified fraction of a length of the second exhaust pipe, and closing the valve such that the first pipe provides a resonator for the second pipe to counteract standing wave in the second pipe.

19 Claims, 3 Drawing Sheets

(56) References Cited

U.S. PATENT DOCUMENTS

| | | | | |
|---|---|---|---|---|
| 8,453,791 | B2 | 6/2013 | Wakatsuki et al. | |
| 9,212,593 | B2 * | 12/2015 | An | F01N 13/0093 |
| 2004/0006970 | A1 * | 1/2004 | Worner | F01N 1/166 60/272 |
| 2008/0078613 | A1 * | 4/2008 | Liu | F01N 1/16 181/237 |
| 2008/0302597 | A1 * | 12/2008 | Kruger | F01N 13/02 181/238 |
| 2010/0043398 | A1 | 2/2010 | Abram et al. | |
| 2014/0166394 | A1 * | 6/2014 | Winkel | F01N 13/107 181/228 |

* cited by examiner

EXHAUST SYSTEM FOR AN ENGINE

TECHNICAL FIELD

Various embodiments relate to an exhaust system for an internal combustion engine in a vehicle.

BACKGROUND

Exhaust systems for internal combustion engines direct exhaust gases formed during the combustion process in the engine to the outside, surrounding environment. Exhaust systems typically include sections of piping. These pipes have standing pressure waves therein that increase noise from the exhaust system based on the frequency of the standing wave and harmonics.

SUMMARY

In an embodiment, an exhaust system for an engine has a volume element, and first and second exhaust pipes connected to and extending downstream of the volume element. The first exhaust pipe has a first length (L1). A valve is positioned in the second exhaust pipe at a distance (D) from the volume element. The distance D is less than L1 such that the second pipe is a resonator for the first pipe with the valve in a closed position.

In another embodiment, an exhaust system for an engine has first and second exhaust pipes arranged as dual exhaust pipes, and a volume element connected to and downstream of the first and second exhaust pipes. The first exhaust pipe has a first length (L1). A valve is positioned in the second exhaust pipe at a distance (D) from the volume element. The distance (D) is a fraction of L1 such that the second pipe is a resonator for the first pipe with the valve in a closed position.

In yet another embodiment, a method of controlling exhaust noise is provided. A valve is positioned in a first exhaust pipe at a distance (D) from a volume element, with the first pipe and a second exhaust pipe connected to the element for dual exhaust flow, and D being less than a length of the second pipe. The valve is closed such that the first pipe provides a resonator for the second pipe to counteract standing wave in the second pipe.

DETAILED DESCRIPTION

As required, detailed embodiments of the present disclosure are provided herein; however, it is to be understood that the disclosed embodiments are merely exemplary and may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present disclosure.

Figure 1:
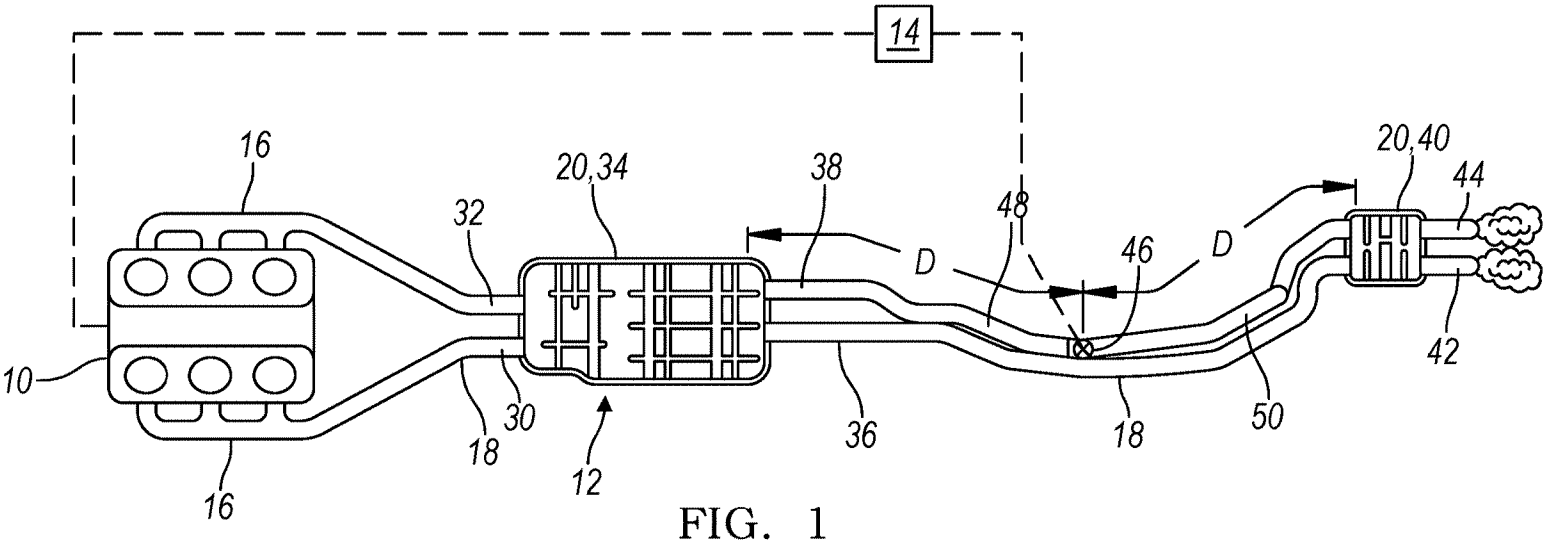
FIG. 1 is a schematic of an engine and an exhaust system according to an embodiment.

FIG. 1 illustrates an internal combustion engine 10 and associated exhaust system 12. The engine 10 may be an internal combustion engine such as a compression ignition engine or spark ignition engine. The engine 10 may have one or more cylinders, and in the present non-limiting example, is illustrated as having six cylinders. The cylinders in the engine may be arranged in an in-line configuration, in a V-configuration, or another configuration. In some embodiments, the engine 10 is used as the sole prime mover in a vehicle, such as a conventional vehicle, or a stop-start vehicle. In other embodiments, the engine 10 may be used in a hybrid vehicle where an additional prime mover, such as an electric machine, is available to provide additional power to propel the vehicle.

The engine 10 includes at least one controller 14 and various sensors configured to provide signals to the controller for use in controlling the air and fuel delivery to the engine, the ignition timing, the power and torque output from the engine, the exhaust system, and the like. Engine sensors may include, but are not limited to, an oxygen sensor in the exhaust system 12, an engine coolant temperature sensor, an accelerator pedal position sensor, an engine manifold pressure (MAP) sensor, an engine position sensor for crankshaft position, an air mass sensor in the intake manifold, a throttle position sensor, an exhaust gas temperature sensor in the exhaust system 12, and the like.

The controller 14, as well as any circuit or other electrical device disclosed herein, may include any number of microprocessors, integrated circuits, memory devices (e.g., FLASH, random access memory (RAM), read only memory (ROM), electrically programmable read only memory (EPROM), electrically erasable programmable read only memory (EEPROM), or other suitable variants thereof) and software which co-act with one another to perform operation(s) disclosed herein. In addition, any one or more of the electrical devices as disclosed herein may be configured to execute a computer-program that is embodied in a non-transitory computer readable medium that is programmed to perform any number of the functions as disclosed herein.

The exhaust system 12 is fluidly connected to the engine 10 for venting and directing exhaust gases from cylinders in the engine to atmosphere. The exhaust system 12 has one or more exhaust manifolds 16 connected to the exhaust ports of the engine cylinders. Piping 18 in the exhaust system 12 connects various components or devices of the exhaust system 12.

The exhaust system 12 includes one or more volume elements 20, i.e. mufflers or silencers, for noise control. The muffler or silencer is an acoustic device for noise control or noise reduction. The muffler or silencer acts to reduce the loudness of the sound pressure created by the engine. The exhaust system 12 may also include one or more emissions control systems (not shown), such as a three way catalyst, catalytic converter, particulate filter, and the like. In some examples, the exhaust system 12 may also include other devices and systems (not shown) such as an exhaust gas recirculation (EGR) system and/or a compression device such as a turbocharger.

As the engine operates, and exhaust gases travel through the exhaust system 12, pressure waves develop in the piping 18 of the exhaust system 12. The engine 10 and exhaust system 12 noise may vary based on the pulsating exhaust gas pressure waves in the piping 18 and the exhaust gas system 12 that form acoustic waves. The noise may vary with engine speed and/or load, and exhaust gas flow rates. The exhaust gas pressure waves include fundamental frequency and higher order harmonics, and the engine exhaust system 12 may also exhibit tones based on the engine 10 operating conditions and geometry of the exhaust system 12. The noise from the engine exhaust system 12 may resonate based on the operating conditions of the engine and exhaust system, with a primary resonance frequency and higher order harmonic frequencies in the acoustic spectrum.

The volume elements 20 may include various mufflers, silencers, or other devices to reduce engine exhaust noise, for example, by dissipating the pressure waves in the exhaust gases. Each volume element 20 may include a muffler with reactive elements such as a series of tubes, baffles, and chambers, a silencer with acoustic fill material to absorb noise, or a combination thereof. The volume elements 20 have a larger effective cross-sectional area than a cross-sectional area of the piping 18 to act as a node for standing wave in connected piping 18. Note that as the cross sectional area, or diameter, of one of the pipes increases, the back pressure decreases and the effectiveness of the muffler also decreases.

At least a portion of the exhaust system 12 is arranged as a dual exhaust system. In a dual exhaust system, the pipe 18 sections are arranged for parallel exhaust gas flow through first and second sections of piping. The engine 10 may provide a single stream of exhaust gases to the exhaust system 12 from a single manifold 16, or may provide first and second separate streams of exhaust gases to the exhaust system 12, for example, using two exhaust manifolds 16 as shown.

In FIG. 1, a first stream of exhaust gases flows through pipe section 30 and into a volume element 20 such as a first muffler 34. A second stream of exhaust gases flows through pipe section 32 and into the muffler 34. In other examples, a single stream of exhaust gases may flow from the engine 10 and into the muffler 34. The first and second streams of exhaust gases may mix within the muffler 34.

Pipe section 36 and pipe section 38 exit the muffler 34, and connect the muffler 34 to a silencer 40 or another muffler or volume element. Pipes 36, 38 extend downstream of the muffler 34. Pipe 36 has a first length (L1), and pipe 38 has a second length (L2). In one example, pipes 36, 38 have an equivalent diameter and substantially equivalent length. For example, pipe 36 may be the same length as pipe 38, or may be within 5-10 percent of the length of pipe 38. In other examples, the pipes 36, 38 may be different in diameter and/or length.

Exhaust gases flowing from pipes 36, 38 into the silencer 40 may mix within the silencer. From the silencer 40, exhaust gases are directed to the external environment, for example, using first and second tailpipes 42, 44 arranged as a dual tailpipe exhaust. In other examples, a single exhaust tailpipe may be provided.

A valve 46 is positioned in the pipe 38. Also, as shown in FIG. 1, pipe 36 is without a corresponding valve such that flow through pipe 36 is unrestricted, and pipe 36 is valveless. The valve 46 is connected to the controller 14 for controlling the position of the valve. In one example, the valve 46 may be a two position valve, and controlled between an open position and a closed position. In other examples, the valve 46 may be controlled to a specified positon between an open and a closed position for variable flow therethrough. The valve 46 provides a variably sized orifice for flow through the pipe 38, with the orifice size ranging from zero in a closed valve position up to the pipe 38 diameter in an open position.

The valve 46 is positioned within the pipe 38 at a specified location, and is spaced apart from any volume elements 20. The valve 46 is positioned at a distance (D) from a volume element, where D is a specified or predetermined fraction of L1, or D is a function of length L1. In one example, with the pipes 36, 38 having substantially equivalent lengths, the valve 46 is positioned at a distance (D) from both volume elements 34, 40. The valve 46 may also be positioned for attenuating and controlling a target resonant frequency in pipe 36. Note that in other systems, flow through a pipe may be controlled using a valve positioned next to or connected to a volume element, which does not result in a noise reducing resonator as provided in the present disclosure.

The controller 14 controls the position of the valve 46. With the valve 46 in a partially or fully open position, exhaust gases flow from the muffler 34 through both exhaust pipe 36, 38, and to the silencer 40. With the valve 46 in a closed position, exhaust gases flow from the muffler 34 through only the exhaust pipe 36 and to the silencer 40. The pipe 38 acts as one or two resonators for pipe 36 with the valve 46 in the closed position based on the exhaust system configuration, and acts to reduce or eliminate standing wave in the pipe 36.

In the present example, as shown in FIG. 1, the valve 46 is positioned at a distance (D) that is one half of the length L1 of pipe 36, with L1 and L2 being equal. As such, the pipe 38 acts as a quarter wave resonator for the pipe 36, with the closed valve 46 acting as the end wall of the resonator. A first section 48 of the pipe 38 between the first volume element 34 and the valve 46 forms a first resonator or first tuner for the pipe 36 with the valve 46 in the closed position. A second section 50 of the pipe 38 between the second volume element 40 and the valve 46 forms a second resonator or second tuner for the pipe 36 with the valve 46 in the closed position. In this configuration, the first and second resonators 48, 50 are each a quarter wave resonator for the pipe 36.

The pipes 36, 38 extend between the volume elements 34, 40, such that the volume elements 34, 40 each provide a node for pressure waves within the first and second pipes 36, 38. With the valve 46 closed, the first resonator formed by pipe section 48 is fluidly connected to the volume element 34 at one of the nodes for the pressure wave in the first pipe 36, and adjacent to the pipe 36 connection to the volume element 34. As the exhaust gases leave the muffler 34 with the valve in a closed position, an acoustic wave, standing wave, or pressure wave is formed in the pipe 36. The first resonator formed by pipe 38 also forms a standing wave that is out of phase from the wave formed in the pipe 36 based on the distance D of the valve 46 from element 34, and is reflected back towards the node at the muffler 34 by the closed valve 46. When D is one half of L1 such that the resonator is a quarter wave resonator, the standing wave in the resonator is one hundred and eighty degrees out of phase from the wave in the pipe 36. The standing wave from the first resonator offsets the standing wave in the first pipe 36 at the node of the muffler 34, and reduces exhaust noise.

With the valve 46 closed, the second resonator formed by pipe section 50 is fluidly connected to the volume element 40 at the other of the nodes for the pressure wave in the first pipe 36, and adjacent to the pipe 36 connection to the volume element 40. As the exhaust gases leave the muffler 34 with the valve 46 in a closed position, an acoustic wave, standing wave, or pressure wave is formed in the pipe 36. Exhaust gases are able to flow from the pipe 36 through the volume element 40 and into the second resonator formed by section 50. The second resonator formed by pipe 38 also forms a standing wave that is out of phase from the wave formed in the pipe 36 based on the distance D of the valve 46 from element 40, and is reflected back towards the node at the element 40 by the closed valve. When D is one half of L1, and the resonator is a quarter wave resonator, the standing wave in the resonator is one hundred and eighty degrees out of phase from the wave in the pipe 36. The standing wave from the second resonator further offsets the standing wave in the first pipe 36 at the node of the silencer 40, and further reduces exhaust noise.

Figure 2:
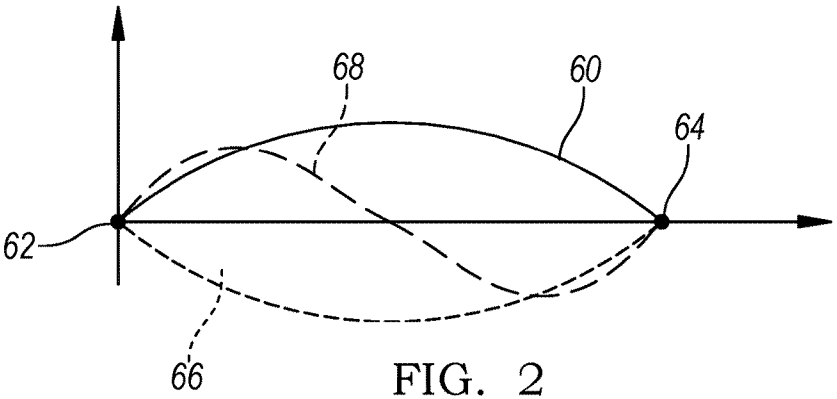
FIG. 2 illustrates a schematic graph pressure waves in the exhaust system of FIG. 1.

FIG. 2 illustrates a schematic of standing wave in the pipe 36, as well as the off-setting quarter wave provided by one of the resonators of the other pipe 38 with the valve 46 in a closed position. The standing wave, shown by line 60, in the pipe 36 extends between two nodes 62, 64 provided by volume elements 34, 40. The quarter standing wave, shown by line 66, is 180 degrees out of phase from line 60, thereby cancelling at least a portion of the acoustic noise produced by the standing wave 60 in the first pipe 36. In further examples, as described below, the second pipe 38 and valve 46 may be used to control or offset higher order harmonics, with a second order harmonic in pipe 36 shown by line 68 for illustrative purposes.

According to one example, first and second resonators provided by pipe 38 and valve 46 are tuned to offset resonance in pipe 36 in a frequency range of 50 to 1500 Hertz, although other frequency ranges are also contemplated. The position of the valve 46, length of the resonators is based on the length of the other pipe, and the target tuning frequency to offset a standing wave. The primary or first resonance in the pipe 36 may be calculated as the speed of sound divided by the length of the pipe 36. The speed of sound may be calculated based on the exhaust gases traveling through the pipe 36, and may be estimated using the equation for the speed of sound for an ideal gas using the universal gas constant (R=8.314 J/mol-K), the molecular weight of the gas (kg/mol), the adiabatic gas constant associated with the exhaust gases, and the absolute temperature of the exhaust gases (K). In one example, the first and second resonators formed by pipe 38 and valve 46 provide a 100 Hertz resonator for the pipe 36 at its primary harmonic resonance, with higher order harmonics occurring at 300 Hz, 500 Hz, and 700 Hz.

Generally, the pipe elements, such as pipes 36, 38, amplify acoustic energy due to their physical properties, most significantly their length. In conventional systems, the resonances in pipe elements may need to be treated with additional volume elements tuned to the pipe's resonant frequency, for example, by adding additional mufflers to an exhaust system, thereby adding cost, weight, and packaging space in a vehicle. In the present disclosure, the addition of a valve 46 to the exhaust system provides an exhaust system 12 with tuned exhaust noise and without the need for additional mufflers or other volume elements to address resonant noise issues. The dual pipes 36, 38 and the valve 46 may result in an improved noise reduction with the pipes 36, 38 each directly connected to a common volume element 20, thereby reducing or eliminating branched connections that would complicate noise propagation and reduction.

With the valve 46 in at least a partially open condition, the valve 46 may additionally provide further benefits by: adding turbulence to the flow of the exhaust gases to reduce the transmission of acoustic waves, providing an expansion ratio across to the valve to provide a pressure drop and reduce the transmission of acoustic waves, and redirecting flow to alternate elements in the system. The valve 46 provides the ability to change a flow element such as pipe 38 into one or more tuning elements, such as the first and second resonator, in order to address the inherent resonance of a second flow element, or pipe 36.

The controller 14 controls the valve 46 position based on engine operating conditions. Low flow of exhaust gases through the pipes 36, 38, such as during engine idle operation or low load, may result in an increased resonance in the pipes 36, 38 because the volume elements, such as muffler 34 are less effective. In one example, the controller 14 controls the valve 46 to a closed position as a function of an engine state such as engine speed and/or engine load, for example, using a lookup table or equation. The controller 14 may receive signals from various sensors indicative of engine operating conditions, such as throttle position, MAF, accelerator pedal position, and the like, to control the position of the valve 46. The controller 14 may send a signal to the valve 46 to close the valve in response to the engine state being below a predetermined value, and open the valve in response to the engine state being above the predetermined value.

In another example, the controller 14 controls the valve 46 to a partially open condition to provide reduced flow through the pipe 38 compared to pipe 36. The controller 14 may control the valve 46 to provide volumetric flow through the pipe 38 that is 15%, 10%, 5% or less of the volumetric flow through the other pipe 36. As such, the partially open valve 46 acts to attenuate noise in the pipe 36 and exhaust system 12 by decreasing the noise across a broader spectrum, thereby providing for further exhaust noise tuning.

Figure 3:
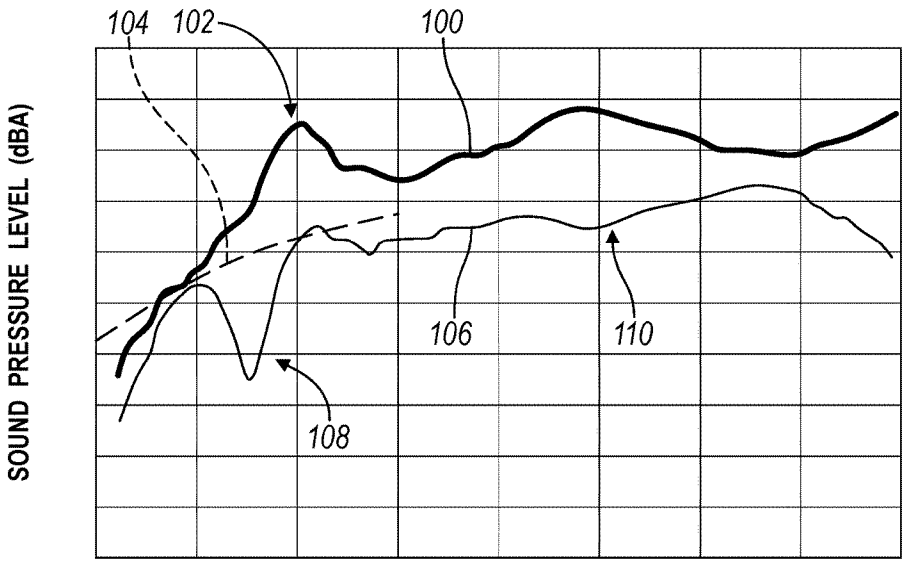
FIG. 3 is a graph illustrating sound pressure levels based on engine speed.

FIG. 3 illustrates sound pressure levels (A-weighted decibels, 5 dB(A) per division) plotted with increasing engine speed (revolutions per minute, 500 rpm per division). Line 100 represents the noise from the exhaust system 12 in FIG. 1 without a valve 46, or with the valve 46 remaining open across all engine speeds. As can be seen in FIG. 3, noise increases to a peak or spike at low engine speeds, e.g. idle speed or low loads, as shown by region 102.

A tuning guide for the engine exhaust noise may specify that the engine noise is not to exceed a profile, as shown by line 104, to control the noise or to meet various regulatory standards or customer expectations. Line 106 illustrates the noise from the exhaust system 12 of FIG. 1 with the valve 46 controlled between an open and a closed position. In region 108, at idle speed or low engine load, the valve 46 is closed by the controller 14 such that all of the exhaust flow between the volume elements 34, 40 is via pipe 36, and pipe 38 forms a first and second quarter wave resonator for pipe 36. As can be seen, the noise from the exhaust system in region 108 is significantly decreased and in fact provides a valley or dip compared to the no valve peak in region 102. Note that if the valve 46 was not completely closed, the noise in region 108 would be attenuated, with a broader and shallower dip or valley. At higher engine speeds, e.g. in region 110, the valve 46 is opened to allow for higher flow rates of exhaust gases to travel through both pipes 36, 38 and to the surrounding environment.

Figure 4:
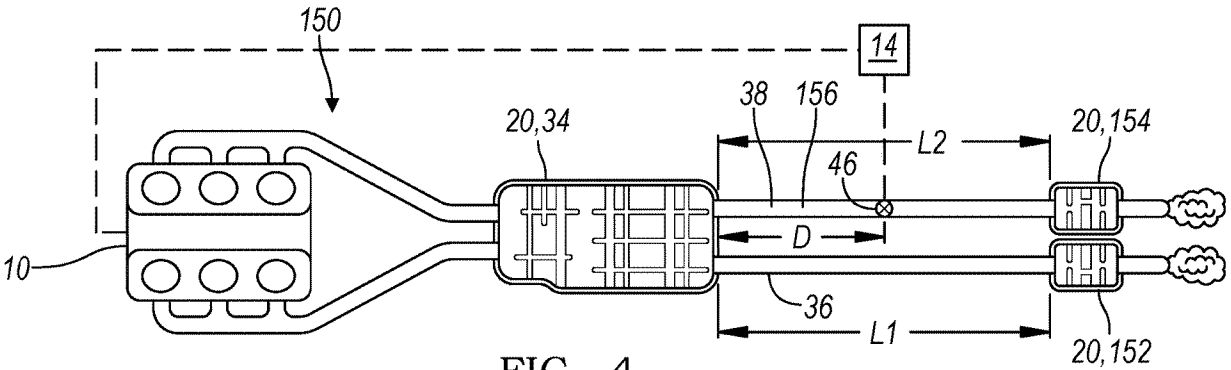
FIG. 4 is a schematic of an engine and an exhaust system according to another embodiment.

FIG. 4 illustrates an exhaust system 150 based on a variation of the exhaust system 12 as described above with respect to FIG. 1. Elements that are the same or similar to those described above with respect to FIG. 1 are given the same reference number.

The first and second exhaust pipes 36, 38 are arranged in a dual pipe, parallel flow configuration and are connected to and downstream of a volume element 20, such as a muffler 34. The first pipe 36 has a first silencer 152 or other volume element, and the second pipe 38 has a second, separate silencer 154 or other volume element. The two silencers 152, 154 are positioned downstream of the muffler 34. The valve 46 is positioned in the second pipe 38 at a distance (D) downstream of the volume element 34. The distance (D) is a function of the length (L1) of the first pipe, and in one example is one half of the length of the first pipe 36 such that a section 156 of the pipe 38 acts as a quarter wave resonator for the first pipe 36 with the valve 46 in a closed position.

In the present example, the lengths of the first and second pipes 36, 38 may the same or may be different. As the first and second pipes are only connected by a single volume element 34, the pipe 38 provides only a single resonator for the pipe 36. The valve 46 in the closed position prevents exhaust gases from flowing through the silencer 154.

Figure 5:
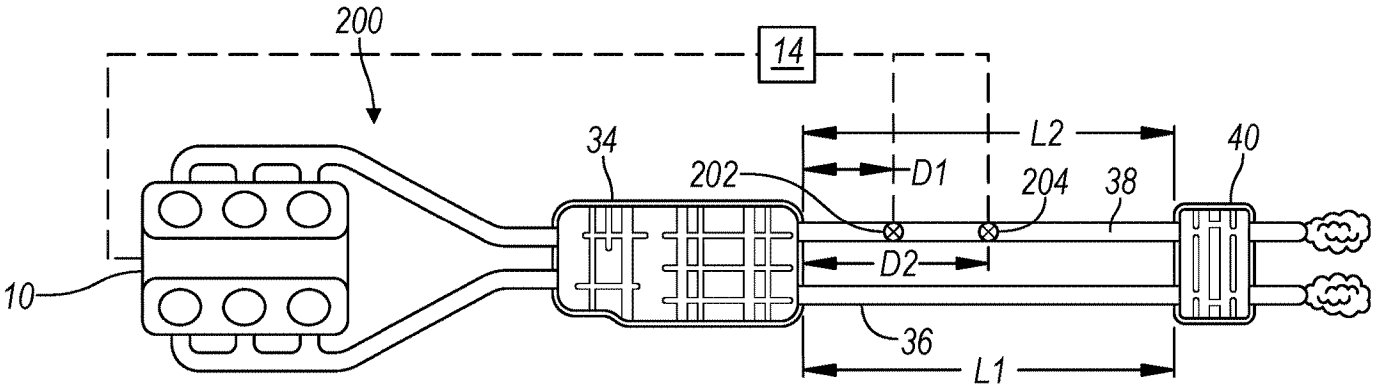
FIG. 5 is a schematic of an engine and an exhaust system according to yet another embodiment.

FIG. 5 illustrates an exhaust system 200 based on a variation of the exhaust system 12 as described above with respect to FIG. 1. Elements that are the same or similar to those described above with respect to FIG. 1 are given the same reference number.

The first and second exhaust pipes 36, 38 are arranged in a dual pipe, parallel flow configuration and are connected to and downstream of a volume element 20, such as a muffler 34. The first and second pipes 36, 38 may be connected to a common silencer 40 downstream as shown, or may be connected to separate silencers as described with reference to FIG. 4.

A first valve 202 is positioned in the pipe 38 at a first distance (D1) from the volume element 34. A second valve 204 is positioned in the pipe 38 at a second distance (D2) from the volume element 34. The valves 202, 204 may be similar to the valve 46 as described above. The controller 14 independently controls the positions of each of the valves 202, 204 based on the operating conditions of the engine and exhaust system to tune exhaust noise and reduce specified harmonics or standing waves in the pipe 36.

The distance D1 of the first valve 202 is based on a specified or predetermined fraction of L1, such that D1 is a function of length L1. When the first valve 202 is closed, the section of the pipe 38 between the muffler 34 and the valve 202 provides a resonator for the pipe 36 with length D1. Note that with the valve 202 closed and the valve 204 open, the remaining section of the pipe 38 between the valve 202 and the silencer 40 provides another resonator with a length (L2-D1) that is tuned to offset a different frequency for the pipe 36.

The distance D2 of the second valve 204 is based on another specified or predetermined fraction of L1, such that D2 is another function of length L1. The distance (D2) is set to be greater than distance (D1). When the second valve 204 is closed, the section of the pipe 38 between the silencer 40 and the valve 204 provides a resonator with length (L2-D2) for the pipe 36. Note that with the valve 202 open and the valve 204 closed, the section of the pipe 38 between the valve 204 and the muffler provides another resonator with a length (D2) that is tuned to offset a different frequency for the pipe 36. The distances D1, D2 may be proportional to one another.

An additional combination of resonators may be provided with both the valves 202, 204 in the closed position, such that a section of the pipe 38 between the muffler 34 and the valve 202 provides a resonator with length (D1) for the pipe 36, and another section of the pipe 38 between the silencer 40 and the valve 204 provides another resonator with length (L2-D2) for the pipe 36. The distances (D1) and (L2-D2) may be the same as one another or may vary from one another based on the lengths L1, L2 of the pipes 36, 38, and the targeted frequencies for tuning.

The controller 14 controls the positions of the valves 202, 204 based on the engine state or engine operating conditions to control the noise to a profile based on the available combinations of resonators from valve 202, 204 positions. For example, at engine idle, the controller 14 may open valve 202 and close valve 204 to provide a longer resonator with length D2 from the section of the pipe 38 from the muffler 34 to the valve 204. As engine speed and/or load increases, the controller 14 may close valve 202, and either maintain the valve 204 in a closed position or open valve 204, to provide a shorter resonator with length D1 from a section of the pipe 38 between the muffler 34 and the valve 202. Generally, the controller will control the valves to shorten the length(s) of the resonator(s) as the engine speed and/or load increases, and will open all valves at higher engine speeds and or loads to allow exhaust gases to flow unrestricted through the pipe 38. Additional valves may be added to the pipe 38 to provide for further resonators for use in tuning the exhaust system; however, the additional valves may add weight, cost, and complexity to the system and the associated benefits may need to be considered.

Figure 6:
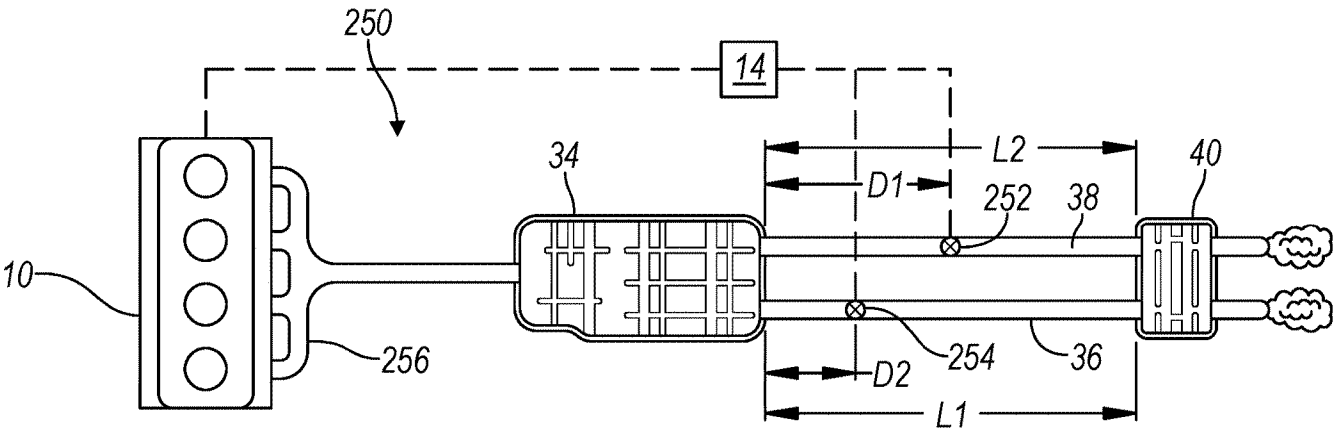
FIG. 6 is a schematic of an engine and an exhaust system according to another embodiment.

FIG. 6 illustrates an exhaust system 250 based on a variation of the exhaust system 200 as described above with respect to FIG. 5. Elements that are the same or similar to those described above with respect to FIGS. 1 and 5 are given the same reference numbers.

The first and second exhaust pipes 36, 38 are arranged in a dual pipe, parallel flow configuration and are connected to and downstream of a volume element 20, such as a muffler 34. The first and second pipes 36, 38 may be connected to a common silencer 40 downstream as shown, or may be connected to separate silencers as described with reference to FIG. 4.

A first valve 252 is positioned in the pipe 38 at a first distance (D1) from the volume element 34. A second valve 254 is positioned in the pipe 36 at a second distance (D2) from the volume element 34. The valves 252, 254 may be similar to the valves 46, 202, and 204 as described above. The controller 14 controls the positions of the valves 252, 254 based on the operating conditions of the engine 10 and exhaust system 250 to tune exhaust noise and reduce specified harmonics or standing wave similarly to that described above with respect to FIGS. 1 and 5, with the exception that one of the two valves 252, 254 is always open during engine operation to provide a pathway for exhaust gases from the engine 10 to the surrounding environment. Therefore, the controller 14 prevents both valves 252, 254 from being closed simultaneously.

The distance D1 of the first valve 252 is based on a specified or predetermined fraction of the length L1 of the other pipe 36, such that D1 is a function of length L1. When the first valve 252 is closed, the section of the pipe 38 between the muffler 34 and the valve 252 provides a resonator for the pipe 36 with length D1. With a shared silencer 40, the remaining section of the pipe 38 between the silencer 40 and the valve 252 provides another resonator with a length (L2-D1) for the pipe 36 with the valve 252 in a closed position. If the pipes 36, 38 have an equal length, and D1 is positioned at the halfway point, the pipe 38 may provide two quarter wave resonators for the pipe 36. If the pipes 36, 38 are different lengths, the distance D1 is based on the length L1 of the pipe 36 and may be set as half of L1 to provide one quarter wave resonator, and another resonator tuned for another frequency.

The distance D2 of the second valve 254 is based on a specified or predetermined fraction of L2 of pipe 38. When the second valve 254 is closed, the section of the pipe 36 between the muffler 34 and the valve 254 provides a resonator for the pipe 38 with length D2. With a shared silencer 40, the remaining section of the pipe 36 between the silencer 40 and the valve 254 provides another resonator with a length (L1-D2) for the pipe 38 with the valve 254 in a closed position. If the pipes 36, 38 have an equal length, D2 may be positioned at other than the halfway point, to provide a resonator at a different frequency than valve 252. If the pipes 36, 38 are different lengths, the distance D2 is based on the length L2 of the pipe 38 and may be set as half of L2 to provide one quarter wave resonator, and another resonator tuned for another frequency.

FIG. 6 also illustrates a variation according to the present disclosure, with the engine 10 having a single manifold or header 256 connected to the muffler 34, or with the muffler 34 having a single exhaust gas inlet before the dual exhaust pipes 36, 38. Note that any emissions control devices or other devices or systems are not illustrated, but would be positioned between the exhaust manifold 256 and an upstream volume element such as muffler 34.

While exemplary embodiments are described above, it is not intended that these embodiments describe all possible forms of the disclosure. Rather, the words used in the specification are words of description rather than limitation, and it is understood that various changes may be made without departing from the spirit and scope of the disclosure. Additionally, the features of various implementing embodiments may be combined to form further embodiments of the disclosure.

What is claimed is:

1. An exhaust system for an engine comprising:

a first volume element;

first and second exhaust pipes connected to and extending downstream of the first volume element, the first exhaust pipe having a first length (L1);

a second volume element connected to the first and second exhaust pipes, and downstream of the first volume element; and a valve positioned in the second exhaust pipe at a distance (D) from the first volume element, wherein D is less than L1, wherein the second pipe is a first resonator for the first pipe and is formed by a first section of the second pipe between the first volume element and the valve in a closed position;

wherein a second section of the second pipe between the second volume element and the valve is a second resonator for the first pipe with the valve in the closed position.

2. The exhaust system of claim 1 wherein D is one half of L1 such that the first resonator is a quarter wave resonator for the first pipe.

3. The exhaust system of claim 1 wherein the second pipe has a second length (L2), with L2 being equal to L1.

4. The exhaust system of claim 1 wherein a diameter of the first exhaust pipe is equal to a diameter of the second exhaust pipe.

5. The exhaust system of claim 1 further comprising a controller to close the valve in response to an engine state being below a predetermined value, and open the valve in response to the engine state being above the predetermined value.

6. The exhaust system of claim 1 wherein D is one half of L1 such that the first resonator and the second resonator are each a quarter wave resonator for the first pipe.

7. The exhaust system of claim 1 wherein the valve is a first valve, the distance (D) is a first distance (D1), the exhaust system further comprising:

a second valve positioned in the second exhaust pipe at a second distance (D2) from the first volume element, wherein D2 is another fraction of L1, wherein D2 is greater than D1, and wherein the second pipe is a third resonator for the first pipe with the first valve in an open position and the second valve in a closed position.

8. The exhaust system of claim 7 wherein the second pipe between the second volume element and the second valve acts as a fourth resonator for the first pipe with the second valve in the closed position.

9. The exhaust system of claim 1 wherein exhaust gases flow through the second exhaust pipe with the valve in an open position.

10. The exhaust system of claim 1 wherein the first exhaust pipe is valveless.

11. The exhaust system of claim 1 wherein the first volume element is one of a muffler and a silencer.

12. The exhaust system of claim 1 further comprising a controller to control the valve to a partially open condition to reduce flow through the second pipe to attenuate and broaden standing wave in the first pipe and tune the exhaust noise.

13. The exhaust system of claim 1 further comprising a controller to close the valve to counteract standing wave in the first pipe at a specified frequency thereby tuning the exhaust noise to a predetermined level.

14. An exhaust system for an engine comprising:

a volume element;

first and second exhaust pipes connected to and extending downstream of the volume element, the first exhaust pipe having a first length (L1), and the second exhaust pipe having a second length (L2);

a first valve positioned in the second exhaust pipe at a distance (D1) from the volume element, wherein D1 is less than L1, wherein the second pipe is a resonator for the first pipe with the first valve in a closed position; and a second valve positioned in the first exhaust pipe at a distance (D2) from the volume element, wherein D2 is a fraction of L2, wherein the first exhaust pipe is a resonator for the second pipe with the second valve in a closed position;

wherein at least one of the first valve and the second valve are in an open position during engine operation.

15. The exhaust system of claim 14 wherein L2 is equal to L1; and wherein D1 is greater than D2.

16. The exhaust system of claim 14 wherein D1 is greater than D2.

17. The exhaust system of claim 16 further comprising a controller configured to close the first valve and open the second valve in response to an engine state being below a first threshold value.

18. The exhaust system of claim 17 wherein the controller is further configured to close the second valve and open the first valve in response to the engine state being between the first threshold value and a second threshold value greater than the first threshold value.

19. The exhaust system of claim 18 wherein the controller is further configured to open the first and second valves in response to the engine state being above the second threshold value.

* * * * *